United States Patent [19]

Christian

[11] 4,149,598

[45] Apr. 17, 1979

[54] RECOVERY OF GAS FROM WATER DRIVE GAS RESERVOIRS

[75] Inventor: Lawrence D. Christian, Houston, Tex.

[73] Assignee: Exxon Production Research Company, Houston, Tex.

[21] Appl. No.: 786,734

[22] Filed: Apr. 11, 1977

[51] Int. Cl.[2] ..... E21B 43/00

[52] U.S. Cl. ..... 166/314

[58] Field of Search ..... 166/314, 268, 265-267, 166/263, 273-275

[56] References Cited

U.S. PATENT DOCUMENTS

| | | | |
|---|---|---|---|
| 1,439,391 | 12/1922 | Alldredge | 166/267 |
| 3,215,198 | 11/1965 | Willman | 166/274 X |
| 3,258,069 | 6/1966 | Hottman | 166/265 X |
| 4,040,487 | 8/1977 | Cook et al. | 166/314 |
| 4,042,034 | 8/1977 | Cook et al. | 166/314 |

*Primary Examiner*—Stephen J. Novosad
*Attorney, Agent, or Firm*—John S. Schneider

[57] ABSTRACT

In a method for recovering more gas from natural water drive gas reservoirs than is recovered using present methods, large volumes of water are produced from the reservoir, and/or from the aquifer adjacent to the reservoir to reduce reservoir pressure. Residual gas after water displacement is thereby left in the reservoir at a lower pressure than it would have been had such water not been produced. Since the quantity of gas, in cubic feet corrected to standard pressure and temperature conditions, left in the reservoir at depletion is a direct function of pressure, use of the this method results in increased gas recovery.

7 Claims, 13 Drawing Figures

RECOVERY OF GAS FROM WATER DRIVE GAS RESERVOIRS

BACKGROUND OF THE INVENTION

The present invention concerns a method for recovering from natural water drive gas reservoirs more gas than can be realized from conventional operation i.e. production of gas until the gas reservoir is eventually watered out. The method can be applied prior to primary depletion in which case it is a means for enhancing primary recovery. Or the method may be applied after the reservoir is watered out by primary depletion in which case it is a true secondary recovery method.

SUMMARY OF THE INVENTION

A method for recovering gas from a natural water drive gas reservoir, in which aquifer water invades the reservoir and traps gas as residual gas, comprises producing water from wells completed in a water zone (that portion of the reservoir invaded by water or the water drive aquifer or both); producing gas from the gas zone (that portion of the reservoir not invaded by water); the rate of water production, the timing of water production relative to gas production and the location of the water production wells being selected to effect reductions in reservoir pressure such that the amount of gas which will be trapped as residual gas, and not produced, will be less than the amount of gas that would have been trapped as residual gas without such water production.

Production of water from the water zone draws down reservoir pressure to a level below that at which the residual gas was trapped by advancing water during primary depletion. As the reservoir pressure declines residual gas expands and becomes mobile in the reservoir and at least part of that mobile gas is then recovered from the gas production wells completed in the gas zone or produced along with water from wells completed in the water zone. The water is preferably produced from wells located near the original gas-water contact.

The water may also be produced from the aquifer to increase recovery during primary depletion. Production of water reduces reservoir pressure maintenance which would otherwise result from water entering the reservoir. Reservoir pressure is reduced to lower levels as gas is produced than it would have been reduced without water production. Since the quantity of gas, in cubic feet corrected to standard pressure and temperature conditions, left in the reservoir at depletion is a direct function of pressure, use of the method results in increased recovery.

In partially watered out gas reservoirs, the method may be used to effect additional, or secondary, recovery from the portion of the reservoir watered out and additional primary recovery from the portion of the reservoir not watered out. In depleting natural water drive gas reservoirs, a program involving producing gas from the gas zone for a period of time and then producing water will yield optimum economics in some instances.

The water production wells may be completed in the watered out part of the reservoir and/or in the aquifer outside the original gas productive limits.

DESCRIPTION OF THE PREFERRED EMBODIMENTS

Figure 1:
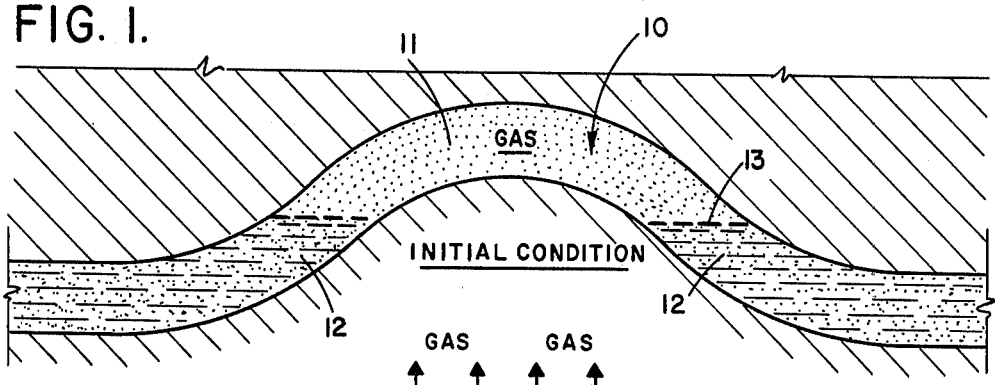
FIGS. 1, 2 and 3 illustrate schematically conventional primary depletion of a natural water-drive gas reservoir.
Figure 2:
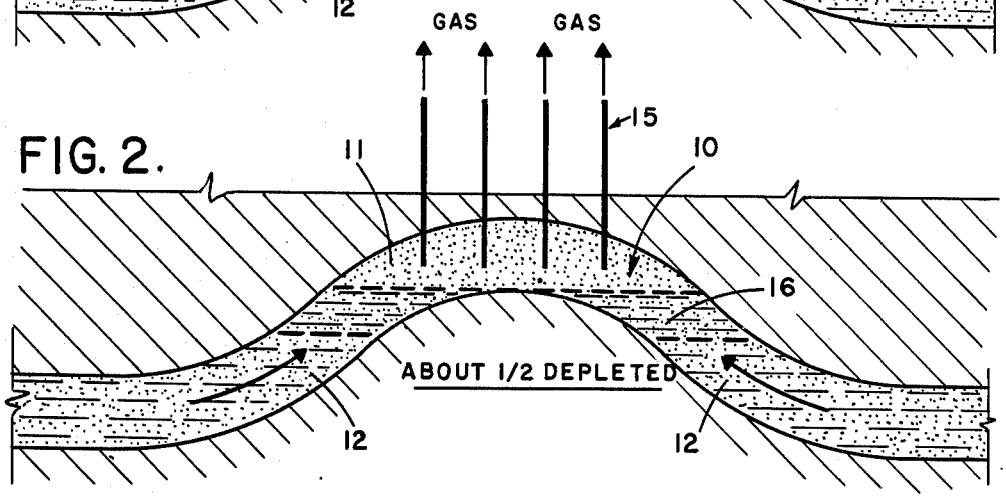

Referring to FIG. 1 there is illustrated a natural water-drive gas reservoir 10 having a gas zone, designated 11, and overlying an aquifer 12. The initial gas-water contact area is designated 13. In FIG. 2 the condition of reservoir 10 is illustrated when reservoir 10 has been about one half primarily depleted by the natural water drive. Gas wells, indicated at 15, completed in reservoir 10 are producing gas and as the reservoir pressure drops because of that gas production water enters reservoir 10 as gas is produced. The area designated 16 (water zone) of the reservoir has been invaded by water from aquifer 12 as indicated by the arrowed lines. Some gas is held by capillary forces in rock pore spaces and thereby trapped as residual saturation in the reservoir rock invaded by water. Gas zone 11 is that portion of reservoir 10 not invaded by water and water zone 16 includes both aquifer 12 and that portion of reservoir 10 invaded by water.

Figure 3:
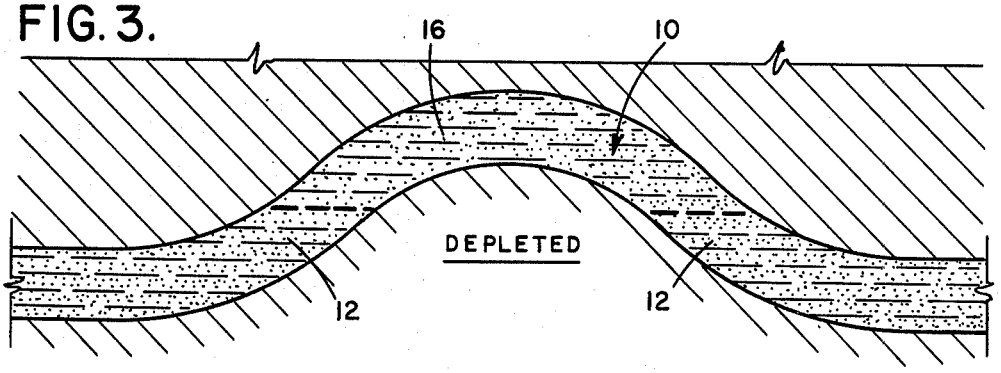

In FIG. 3 reservoir 10 is shown in its depleted state. Water has invaded all of gas zone 11 of reservoir 10. All producing wells have been closed-in due to water production. The water invaded zone 16 of the reservoir contains 20 to 30 percent residual gas saturation and the pressure in the reservoir is dependent on the rate at which the reservoir was depleted and the strength of the water drive from aquifer 12.

Figure 4:
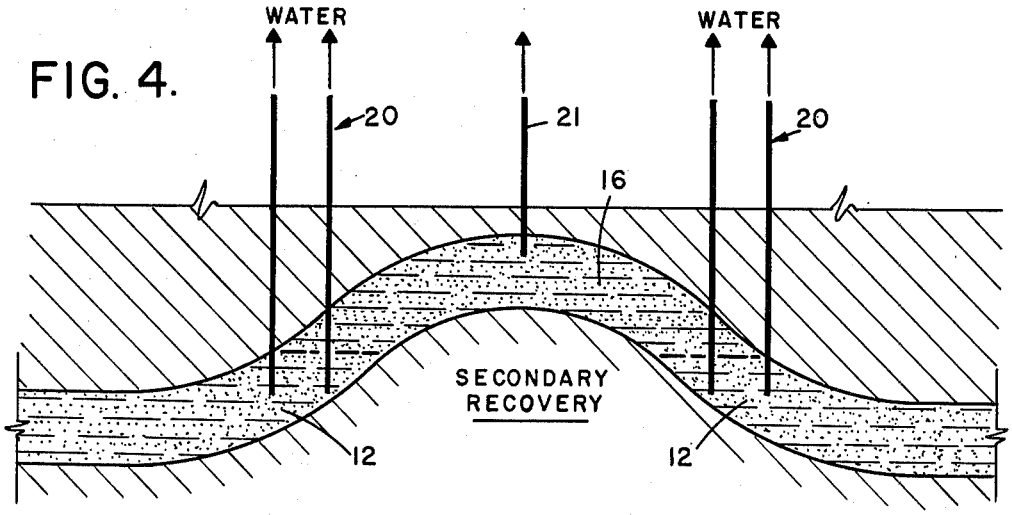
FIG. 4 is a schematic illustration of the method for recovering gas, in accordance with the method of this invention, from a depleted natural water-drive gas reservoir.

Referring to FIG. 4, in which the secondary recovery process in accordance with the invention is illustrated, water production wells 20 completed in aquifer 12 and a gas production well 21 completed in the watered out portion 16 of reservoir 10 are shown. Large volumes of water are produced through wells 20 following depletion of the reservoir by conventional operation. Withdrawal of such large volumes of water reduces pressure throughout reservoir 10. The residual gas in the watered out zone 16 of reservoir 10 expands as reservoir pressure declines. The gas in excess of that required to fill residual gas pore volume flows and is produced along with water through wells 20 and 21. In reservoirs which have high dip angles and high permeability, gravitational forces will cause some mobile gas to flow to the crest of the structure where it can be produced separate from water through, for example, gas production well 21. The percentage of residual gas recovered is a function of the pressure draw-down effected. In a reservoir where the residual gas was trapped at 2000 psig pressure, approximately half of the residual gas can be recovered by pulling the pressure down to 1000 psig Wells 20 completed in aquifer 12 just outside the original gas reservoir 10 are particularly effective in that (1) the pressure draw-down is effective through the entire reservoir and (2) such wells will have higher productivity than wells completed in rock containing residual gas saturation i.e. the watered out reservoir.

Figure 5:
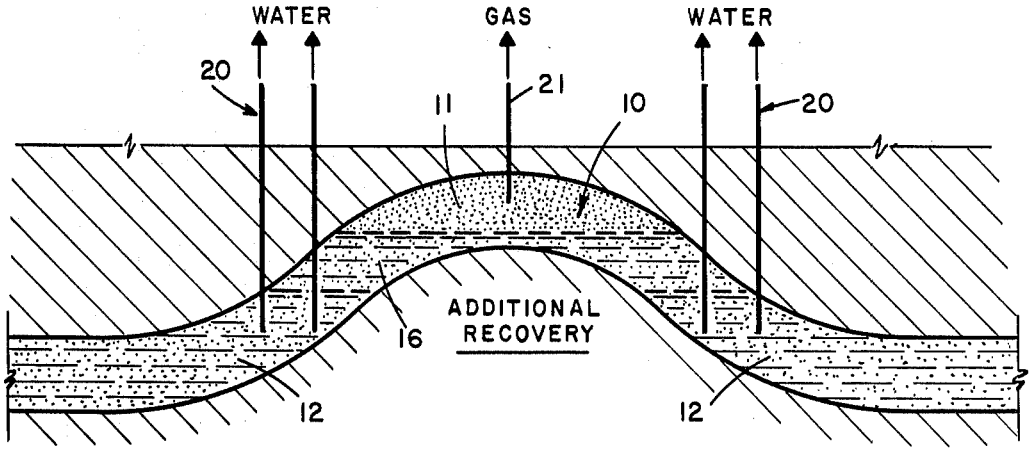
FIG. 5 is a schematic view of a reservoir illustrating a modification of the method of this invention in which additional gas recovery is achieved prior to primary depletion of the water-drive gas reservoir.

Referring to FIG. 5, reservoir 10 is shown in a partially depleted state in which water production wells 20 are producing large volumes of water from aquifer 12 and a gas well 21 completed in gas zone 11 of reservoir 10 is producing gas. Thus, large volumes of water are being produced simultaneously with primary gas production through well 21 to pull the reservoir pressure down to a lower level than would be achieved without the water production. Similar advantages are achieved in gas recovery as in the secondary recovery process described above. The water production can be conducted during the entire time gas is produced or water production can be initiated sometime after gas production is started. While shown completed in the aquifer, wells 20 may also be completed in the watered out part 16 of reservoir 10. The most effective location for water withdrawals is near the original reservoir gas-water contact across which water influx is occurring although additional gas recovery can be achieved by producing large volumes from any location in the watered out portion of the reservoir or aquifer.

To illustrate operation of the invention its simulated application to an existing reservoir, the Katy V-C reservoir, will now be made. The Katy V-C reservoir was discovered in 1936. The reservoir was cycled by injecting dry gas and producing wet gas until 1969. The volumes of gas produced exceeded the volumes injected by minor amounts. Blowdown at high rates was then commenced and was completed in mid 1973. During blowdown, reservoir pressure (always measured in the part of the reservoir not invaded by water) was drawn down from about 2300 to 1100 psig. However, over 75 percent of the 88 billion cubic feet (Bcf) of gas left in the reservoir was trapped as residual to water displacement at pressures above 2000 psig and has not subsequently been depressured to less than 2000 psig.

A one dimensional radial numerical simulation model was developed to provide a basis for predicting reservoir behavior with a secondary recovery program using the method of this invention. The model was similar to one described in a Paper (6166) by J. L. Lutes et al which was presented at the 51st Annual Fall Technical Conference and Exhibition of the Society of Petroleum Engineers of AIME, New Orleans, La., Oct. 3–6, 1976. Certain modifications were made in the model, the most important of which was inclusion of solution gas in aquifer water. The model had 17 rings with the inner 14 representing the gas reservoir and three large outer rings representing the aquifer.

Figure 6:
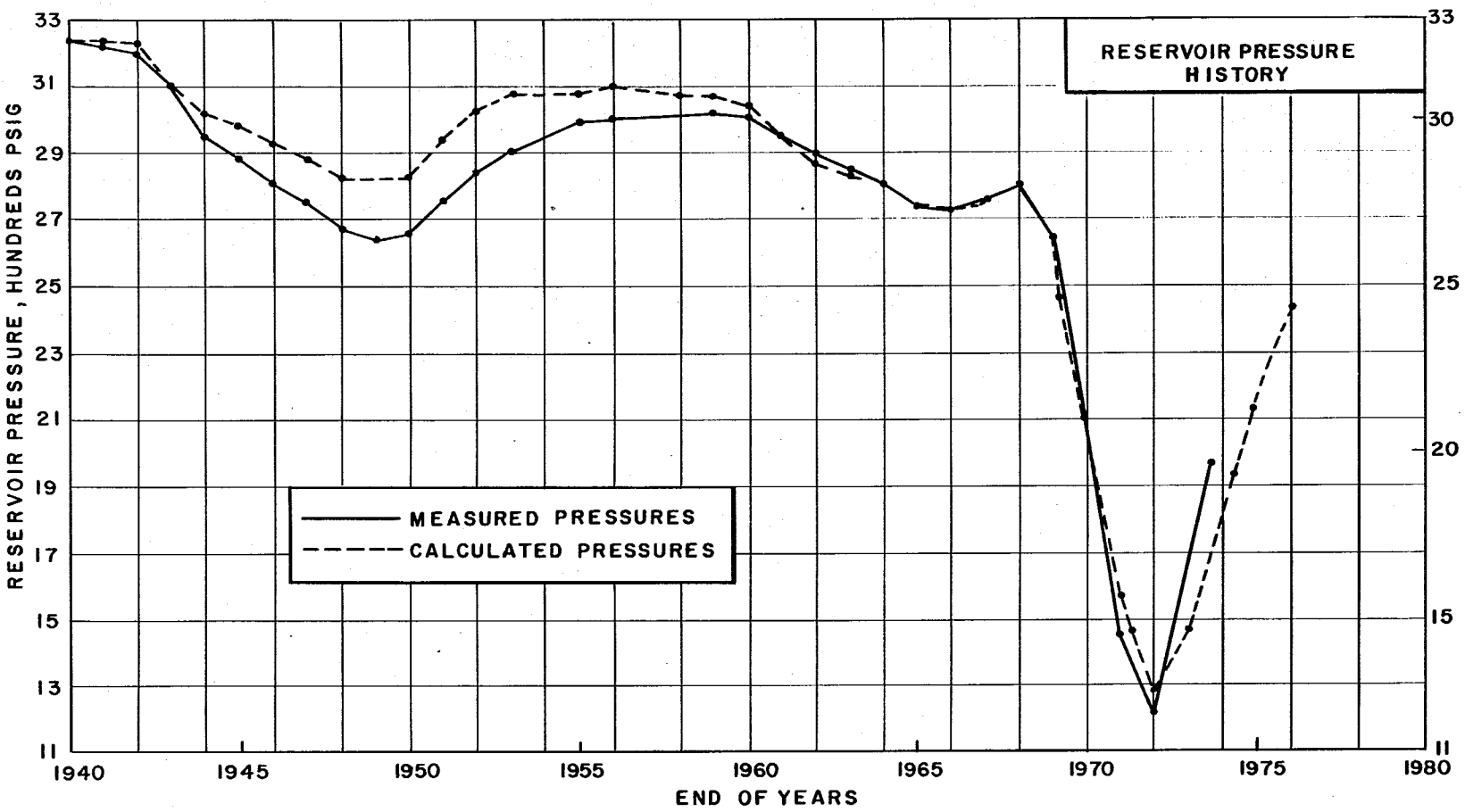
FIG. 6 is a plot of years versus reservoir pressure for the Katy V-C reservoir.

The production history of the Katy V-C reservoir was simulated to establish validity of the numerical model and current saturation and pressure distribution. FIG. 6 shows measured and calculated (using the model) historic pressures from 1940 through 1976. It is to be noted that correspondence is good especially since 1960.

Figure 7:
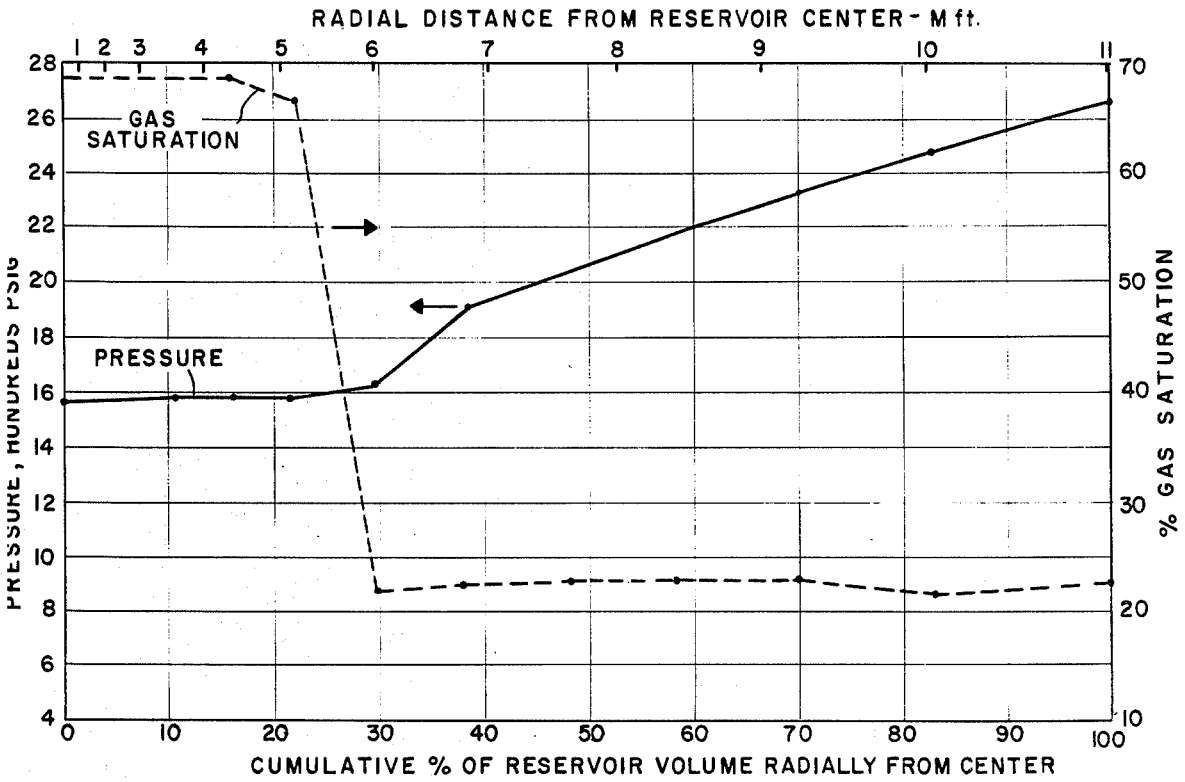
FIG. 7 is a plot showing calculated gas saturation and pressure profiles at the end of 1971 for the Katy V-C reservoir.

FIG. 7 shows calculated gas saturation and pressure profiles at the end of 1971 when the reservoir was about two thirds watered out. In this Fig. and in FIGS. 8 and 11 "M ft" means "thousand feet". Relative permeability to gas in the model was zero at 23 percent and less gas saturation. Compression due to pressure increase since gas trapping occurred is shown by saturations less than 23 percent, such as at 10,000 feet from the reservoir center. Where gas saturations behind the water front are above 23 percent (from about 8000 to 9500 feet radial distance) reservoir pressure is less than that at which trapping occurred. Gas is percolating inward from this reservoir volume but is being trapped and accumulated in the reservoir just inward from 8000 feet.

Figure 8:
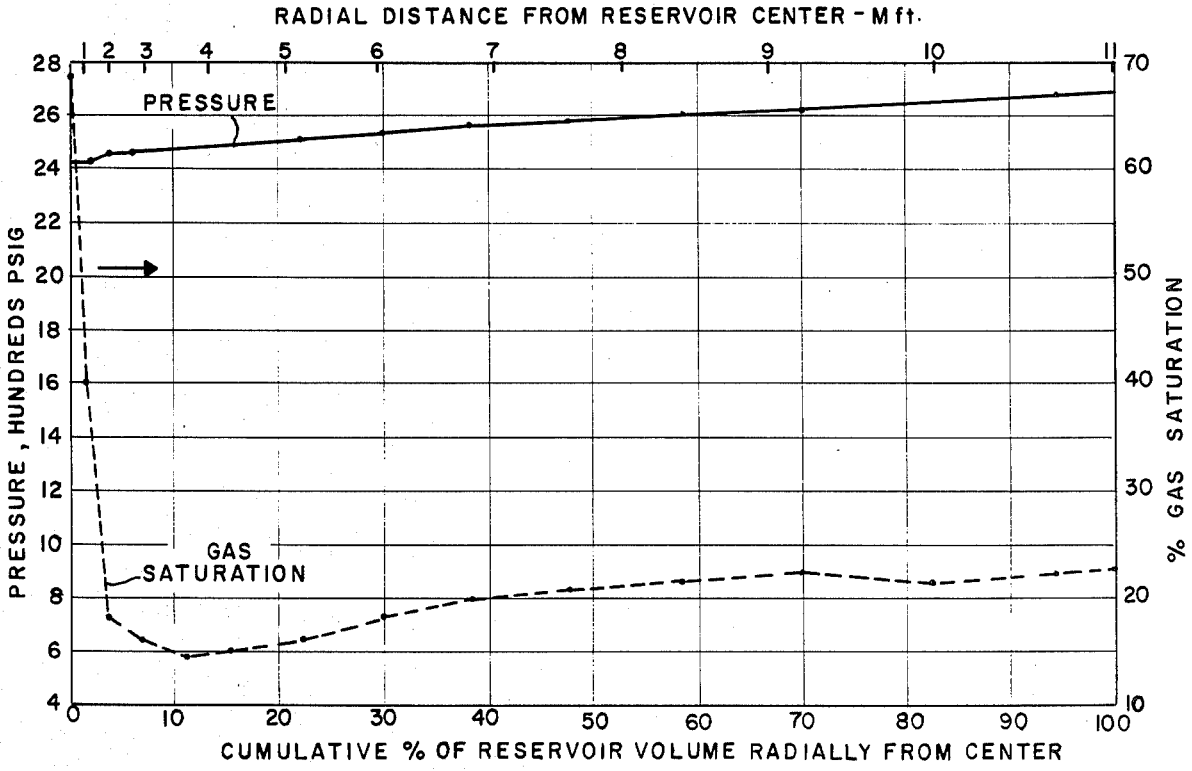
FIG. 8 is a plot showing calculated gas saturation and pressure profiles at the end of 1976 for the Katy V-C reservoir.

FIG. 8 shows calculated gas saturation and pressure profiles at the end of 1976, after three years of reservoir shut-in. The gas saturation profile shows that a fairly large fraction of the reservoir (about one third) has saturation well below 23 percent and will require fairly substantial depressuring before gas will become mobile. Gas will become mobile after minor depressuring in the remaining two thirds of the reservoir.

Figure 9:
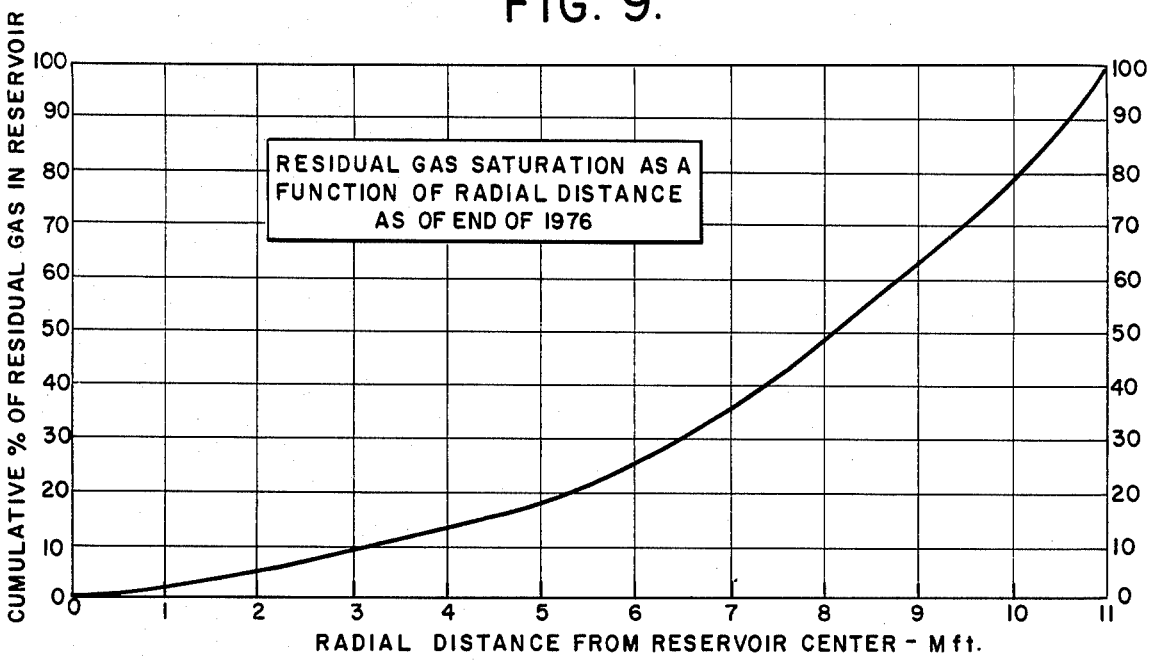
FIG. 9 is a plot showing the calculated location of residual gas in the Katy V-C reservoir at the end of 1976.

FIG. 9 shows the calculated location of the residual gas in the Katy V-C reservoir at the end of 1976. It is consistent with the profiles in FIG. 8. Over 75 percent of the residual gas in the reservoir is located in the outer half of radial distance from the center of the reservoir.

FIGS. 8 and 9 show that a secondary recovery program based on pulling reservoir pressure down must reduce reservoir pressure throughout the reservoir in order to be effective. A "conventional" production program with withdrawals concentrated toward the center of the reservoir would be among the least effective programs that could be designed. The secondary recovery program simulated in the model was production of 200,000 barrels of water per day from 30 to 40 wells completed in the aquifer just outside the original productive limit of the reservoir and production of 8000 barrels of water per day from 3 to 5 wells completed near the center of the reservoir. Mobile gas would be produced along with the water in both groups of wells.

In the model, withdrawal of 200,000 stock tank barrels/day(STB/D) of water from ring 14 (in the reservoir) at gas-liquid ratios calculated from model saturations was specified for the outer wells; and withdrawal of 8000 STB/D for 2 years followed by 4000 STB/D for 3 years from ring 3 (in the reservoir) at gas-liquid ratios calculated from model saturations was specified for the inner wells. The withdrawals were started on Jan. 1, 1977.

Figure 10:
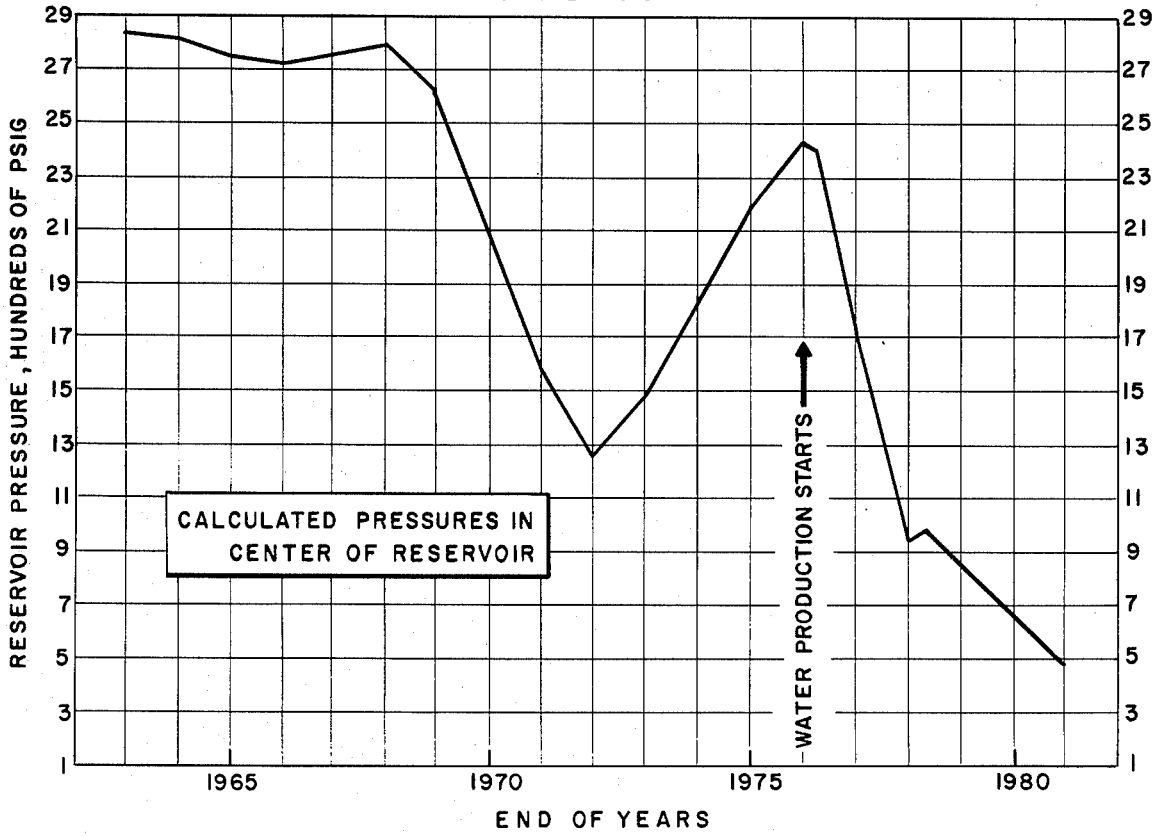
FIG. 10 is a plot showing the effect on reservoir pressure in the center of the Katy V-C reservoir (ring 1) of the water withdrawal.

FIG. 10 shows the effect on reservoir pressure (in ring 1) of the withdrawals with production of water starting in 1976. Pressure is drawn down to about 1000 psig in 2 years (1978) and to 500 psig in 5 years (1981). The "bump" at the first quarter of 1979 is caused by reducing water production from ring 3 from 8000 barrels per day (B/D) to 4000 B/D.

The rings had the following outer radii in feet:

Ring 1 = 800
Ring 2 = 1,600
Ring 3 = 2,400
Ring 4 = 3,200
Ring 5 = 4,000
Ring 6 = 4,800
Ring 7 = 5,600
Ring 8 = 6,400
Ring 9 = 7,200
Ring 10 = 8,000
Ring 11 = 8,800
Ring 12 = 9,600
Ring 13 = 10,400
Ring 14 = 11,050
Ring 15 = 15,000
Ring 16 = 60,000
Ring 17 = 110,050

Figure 11:
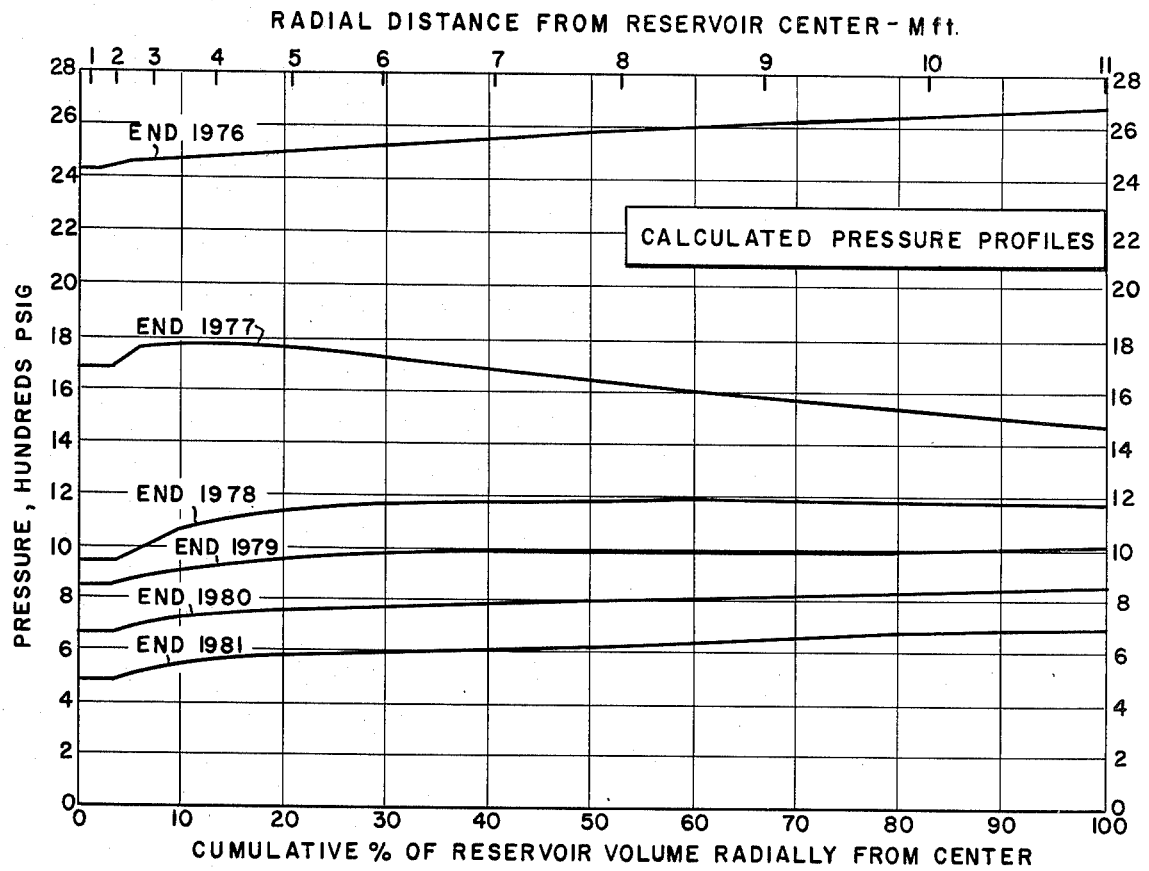
FIG. 11 is a plot showing the calculated reservoir pressure profiles at the end of 1976 and at the end of each of the five years of the simulated application of the invention.

FIG. 11 shows calculated reservoir pressure profiles at the end of 1976 and at the end of each of the 5 years of the simulation period. Three years (to the end of 1979) is about the viable life of the program as defined, since reservoir pressure is less than 1000 psig beyond this date. About 1000 psig reservoir pressure will be required to maintain the desired well production rates.

Figure 12:
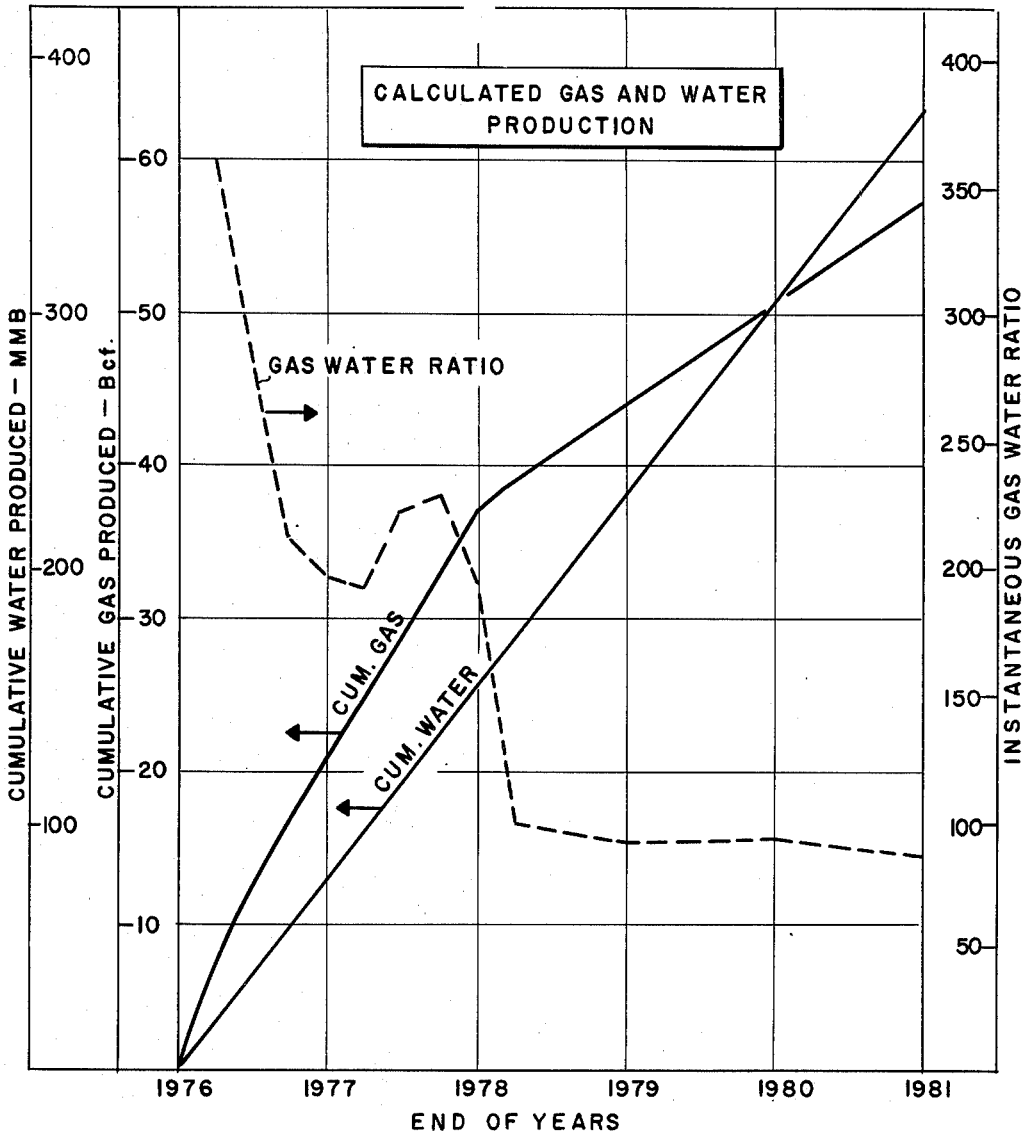
FIG. 12 is a plot showing cumulative gas and water produced during the simulated application period and the instantaneous gas-water ratio.

FIG. 12 shows plots of cumulative gas (Bcf-billion cubic feet) and cumulative water produced (MMB-million barrels) during the secondary recovery program and the instantaneous gas water ratio (GWR). The "bump" in the GWR curve is caused by gas production from the inner wells (ring 3). These wells produced little free during 1976 because of low initial gas saturation in ring 3. By 1977, ring 3 was dewatered and depressured enough (with a corresponding increase in the gas saturation) so that the inner wells commenced producing free gas at increasing GWRs; two phase flow accelerated pressure decline and GWR buildup with the result that a decrease in water production rate was necessary. The GWR of ring 3 wells declined rapidly following the water production decrease.

Figure 13:
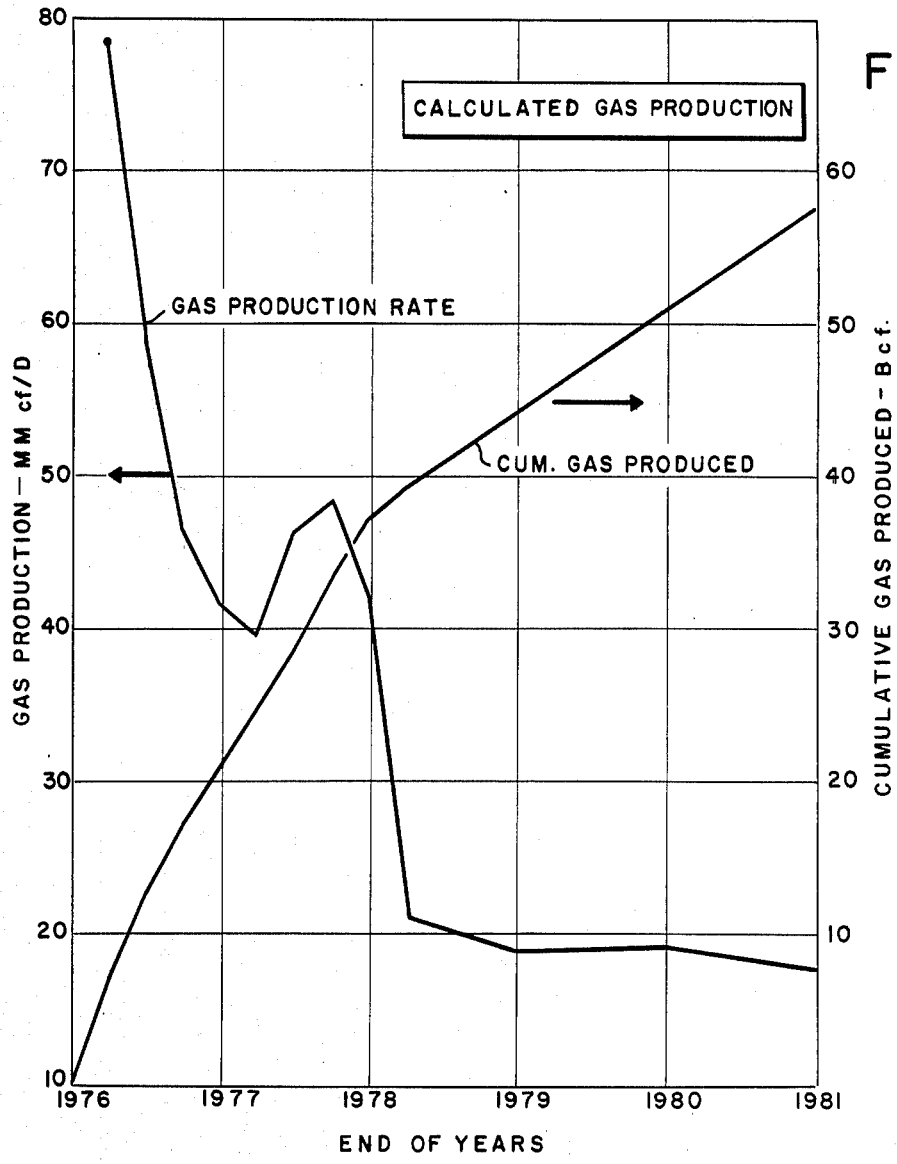
FIG. 13 is a plot showing instantaneous and cumulative gas production profiles.

FIG. 13 shows instantaneous (MMcf/D-million cubic feet per day) and cumulative gas production (Bcf) profiles. Gas production commences soon after initiation of water production, rapidly reaches a maximum and then trends downward for the remainder of the simulated secondary recovery program. The 1978 "bump" is as explained above for FIG. 12.

The following Table I summarizes calculated annual gas production and information on cumulative recovery during the 5 year simulated application.

TABLE I

| | | End of Year Cumulative Production, Bcf | | | |
|---|---|---|---|---|---|
| Year | Average MMcf/D | Total | From Water Solution | From Residual Gas Saturation | Percent of End 1976 Residual Gas Saturation Recovered |
| 1977 | 57.5 | 21.0 | 0.9 | 20.1 | 27.5 |
| 1978 | 43.6 | 36.9 | 1.7 | 35.2 | 48.2 |
| 1979 | 19.2 | 43.9 | 2.4 | 41.5 | 56.8 |
| 1980 | 18.9 | 50.8 | 3.1 | 47.7 | 65.3 |
| 1981 | 18.1 | 57.4 | 3.7 | 53.7 | 73.6 |

The figures of Table I show that recovery to the end of 1979 (previously defined as the probable end of the secondary recovery program viability) is 56.8 percent of residual gas in place plus an additional 2.4 Bcf from solution in reservoir and aquifer water.

Katy V-C reservoir and aquifer water should be saturated with gas based on geological considerations. A sample of reservoir water at 2020 psig obtained in 1974 measured 10.9 standard cubic feet of solution gas per barrel of sample, which is in line with published saturation correlations. Solution gas in the numerical simulation reservoir and aquifer water was as shown in the following Table II.

TABLE II

| Pressure psig | Solution Gas scf/B |
|---|---|
| 100 | 0.8 |
| 1,000 | 6.3 |
| 2,000 | 10.8 |
| 3,300 | 14.7 |

With the requirement to produce 200,000 barrels of water per day, rates which can be maintained from individual wells are very important to economic viability. Calculated well productivity is 19 (krw) B/D/psi where krw is relative permeability to water. Relative permeability to water at imbibition residual gas saturation is estimated to be 0.122, so calculated productivity inside the reservoir limits is about 2.3 B/D/psi. Allowing for some well damage, a well should be able to make 1000 to 1500 B/D if lifted from bottom—so long as reservoir pressure is above 1000 psig. If the outer wells are completed outside the original reservoir production limits, gas saturation will be about 0.2 percent initially and should stabilize at drainage equilibrium saturation of about 3 percent in the immediate vicinity of wells. Relative permeability would be about 0.8 and the calculated producitivity, 15.2 B/D/psi. Allowing for some well damage, wells lifted from bottom should be capable of producing 8000 to 10,000 barrels per day so long as reservoir pressure is above 1000 psi.

Changes and modifications may be made in the illustrative embodiments of the invention shown and described herein without departing from the scope of the invention as defined in the appended claims.

Having fully described the nature, operation, advantages and objects of my invention I claim:

1. A method for recovering gas from a normally pressured natural water drive gas reservoir in which the aquifer water invades the reservoir comprising the steps of:

lifting large volumes of water from wells completed in a water zone, said wells being producible only by lifting and said water zone being the water drive aquifer or that portion of said reservoir invaded by water or both;

producing gas wells completed in a gas zone, said gas zone being that portion of the reservoir not invaded by water;

the rate of water production, the timing of said water production relative to gas production and the location of said water wells being selected to effect reductions in reservoir pressure such that the amount of gas which will be trapped as residual gas, and not produced from said reservoir, will be less than the amount of gas that would have been trapped as residual gas without said water production.

2. A method as recited in claim 1 in which said gas zone gas is produced simultaneously with said water production.

3. A method as recited in claim 1 in which said gas zone gas and said water are produced at different times.

4. A method as recited in claim 1 in which said water wells are completed near the original gas-water contact.

5. A method as recited in claim 1 in which said water is produced from said aquifer during primary depletion of said reservoir.

6. A method as recited in claim 1 in which said water is produced during secondary recovery of gas from said reservoir.

7. A method as recited in claim 1 in which water is produced only from said aquifer.

* * * * *